United States Patent [19]

Natkins

[11] 4,321,952

[45] Mar. 30, 1982

[54] STRAP TIGHTENING HAND TOOL

[75] Inventor: Ephraim Natkins, Jackson Heights, N.Y.

[73] Assignee: American Casting & Mfg. Corporation, Plainview, N.Y.

[21] Appl. No.: 113,729

[22] Filed: Jan. 21, 1980

[51] Int. Cl.[3] ..... B21F 9/02

[52] U.S. Cl. ..... 140/93.2; 140/123.6; 254/250

[58] Field of Search ..... 140/93.2, 123.6, 123.5; 254/250, 251, 252, 253; 53/138 A, 417, 583

[56] References Cited

U.S. PATENT DOCUMENTS

Re. 26,492 11/1968 Caveney et al. ..... 140/123.6 X 2,622,460 12/1952 Keeble ..... 140/93.2 X 4,093,005 6/1978 Eberhardt et al. ..... 140/123.6

*Primary Examiner*—Gil Weidenfeld

*Assistant Examiner*—K. J. Ramsey

*Attorney, Agent, or Firm*—Holland, Armstrong, Wilkie & Previto

[57] ABSTRACT

An improved hand tool is disclosed for tightening strap fasteners such as money bag seals or cable ties or the like. The tool is a plier-like device having a pair of jaws including a pawl mechanism which engages teeth on the strap. After the fastener is drawn tightly around the bag neck or cable with a predetermined fastening force, the tool automatically severs the fastener. A knife on the tool then is used to cut the free end from the fastener.

5 Claims, 8 Drawing Figures

1
2
3
6
17
18
24
25
28
32
39
40

Fig. 5.
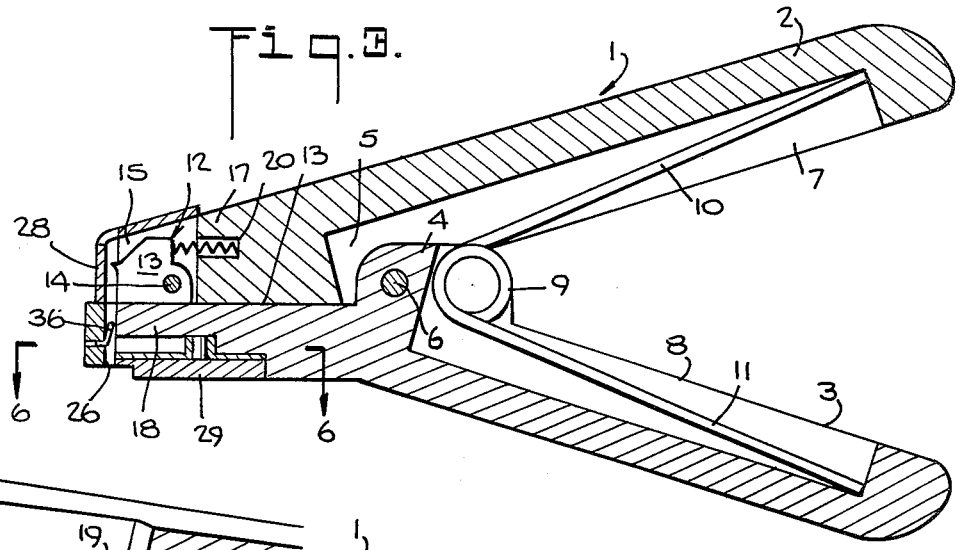
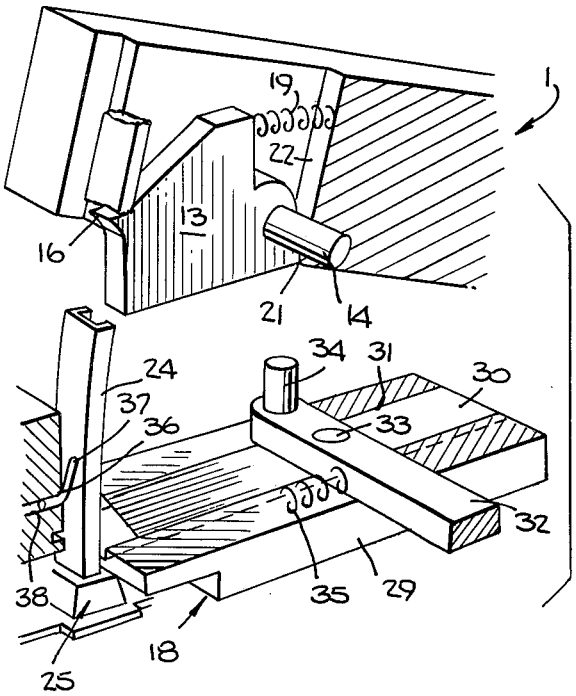
Fig. 7.
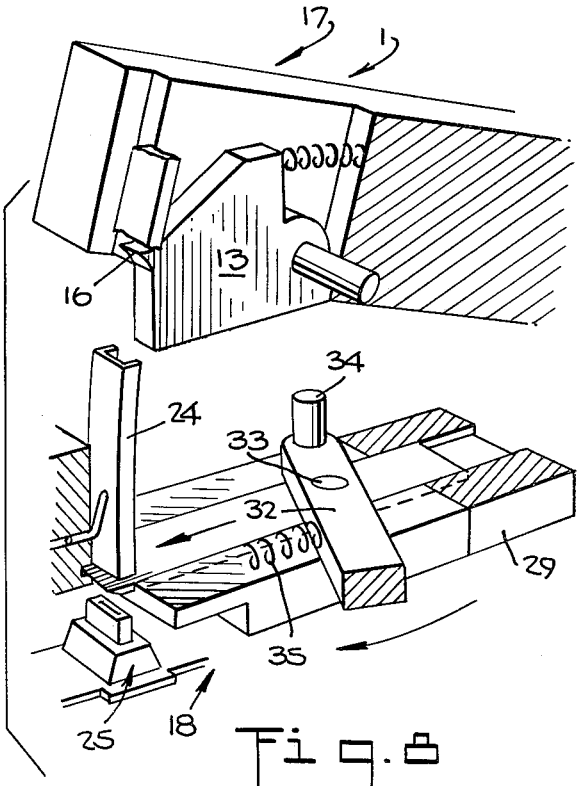
Fig. 8
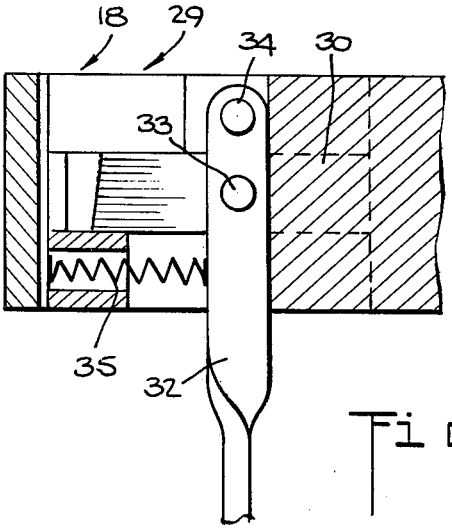
Fig. 6.

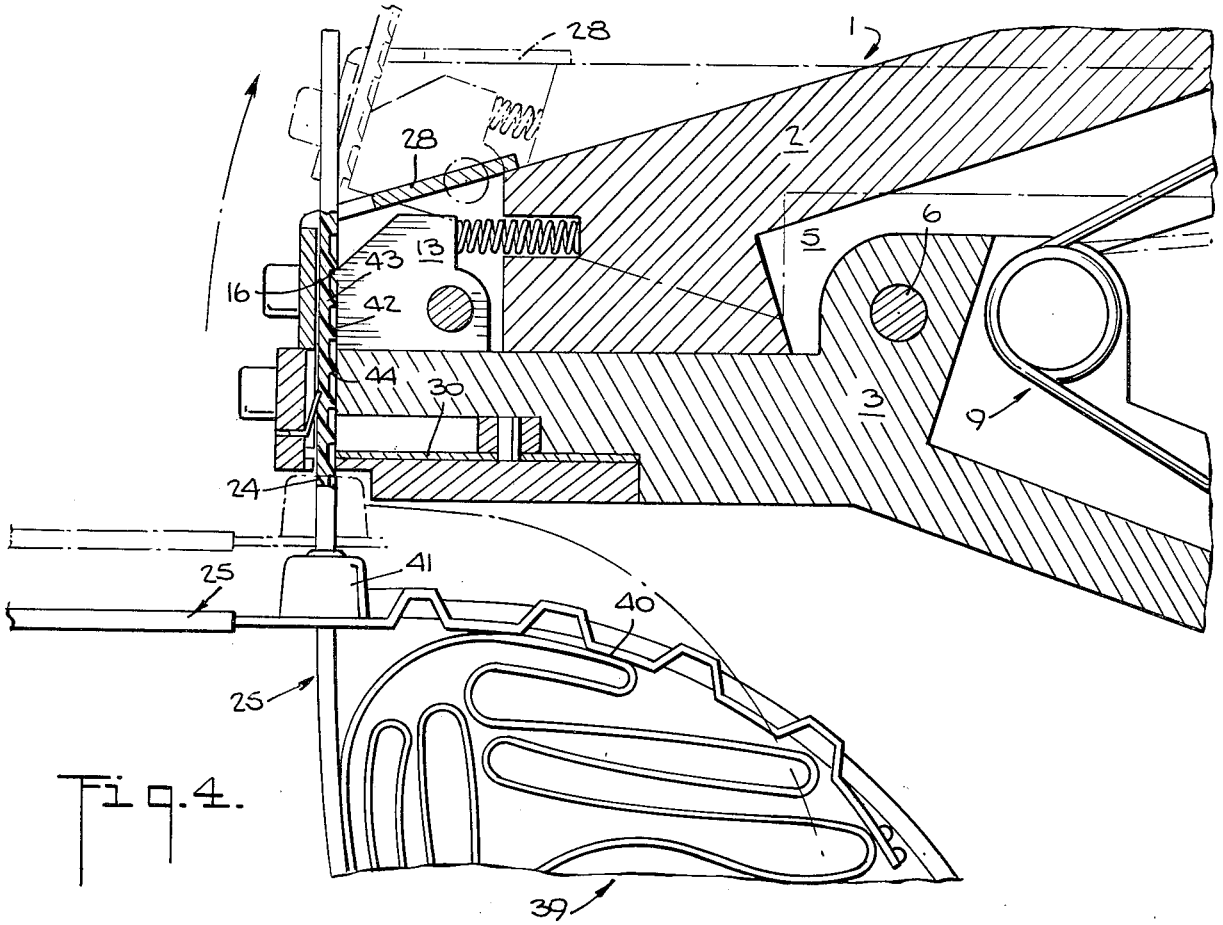
Fig. 4.
Fig. 5.
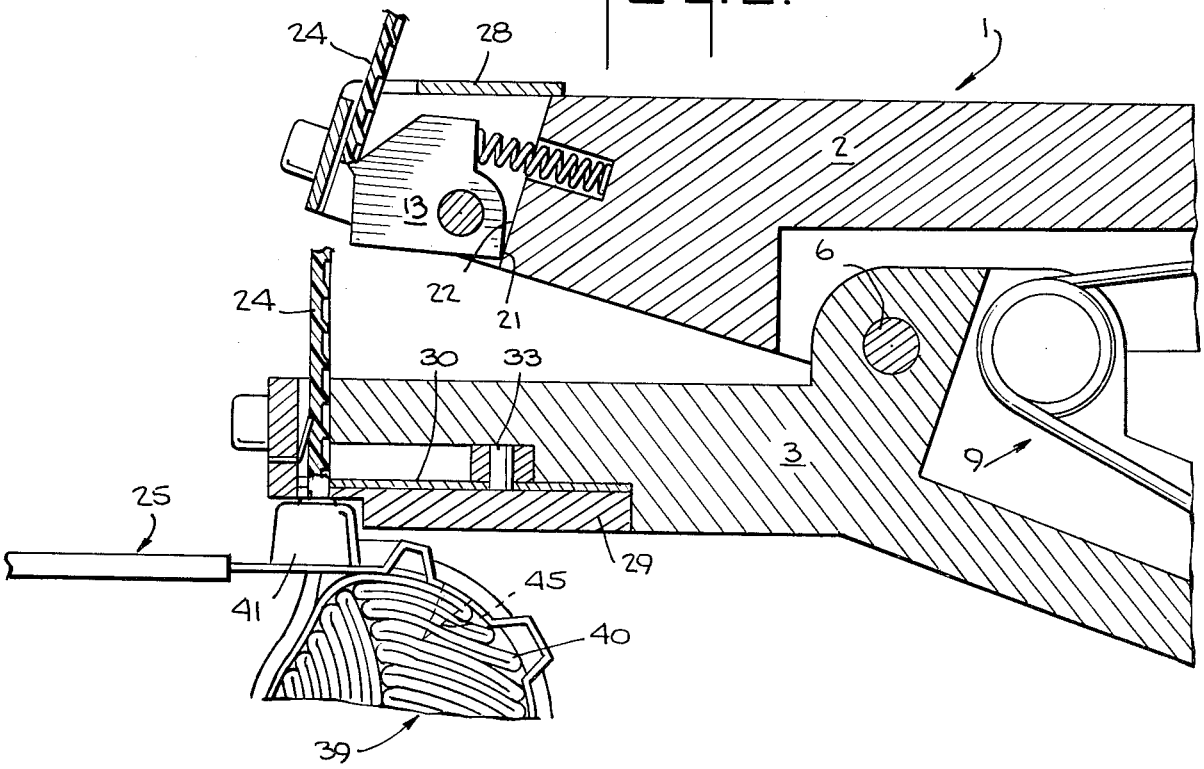

STRAP TIGHTENING HAND TOOL

BACKGROUND OF THE INVENTION

This invention relates to means for tightening and cutting strap fasteners and more particularly to such a tool particularly adapted for tightening and cutting bag seals or cable ties.

There are a number of differing designs of fasteners such as bag ties or cable ties which include an elongated toothed strap end which is pulled through a cooperating locking pawl as the tie is used such as in sealing a money bag. While these fasteners may be applied by hand, it is desirable when they are used as bag seals that they be pulled very tightly around the neck of the sealed bag to prevent their unauthorized removal. This result is obtained by the improved hand tool of this invention which automatically assures the proper sealing force.

Additionally, the tool includes a cooperating cutting knife so that the tie may be cut off immediately adjacent to its locking pawl thereby preventing an unauthorized person from tampering with the seal and from reusing it. When applied by the tool, the only possible manner for removing the seal is to destroy it whereby the tampering is clearly indicated. While there are known tools for use on ties and particularly on the widely used molded plastic ties, these prior tools do not include simple and reliable tension controls and the tie cutting means such as those included in the present hand tool.

Accordingly, an object of the present invention is to provide an improved hand tool for tightening fasteners such as bag tie seals, cable ties and the like.

Another object of the present invention is to provide a hand tool for a high tension seal which is automatically controlled.

Another object of the present invention is to provide a hand tool which requires the important tie cutting step before the tool may be removed whereby the cut is provided at the proper position.

Another object of the present invention is to provide a hand tool for tightening fasteners which is simple to manufacture and which has a small size, few parts and a light weight.

Another object of the present invention is to provide a hand tool for tightening fasteners such as strap seals which is useful for both money bags and cable ties.

Other and further objects of the present invention will become apparent upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings, forming a part of the specification, wherein:

FIG. 3 is a side elevational view, partially in section, illustrating the preferred embodiment of the hand tool in accordance with the present invention.

FIGS. 4 and 5 are enlarged detailed vertical sectional views illustrating successive steps in a money bag sealing operation.

FIG. 6 is a horizontal sectional view taken along line 6—6 on FIG. 3.

FIGS. 7 and 8 are enlarged detailed perspective views of the hand tool cam and tie cutting means in successive positions during the seal cutting.

DESCRIPTION OF THE PREFERRED EMBODIMENT

Figures 1, 2:
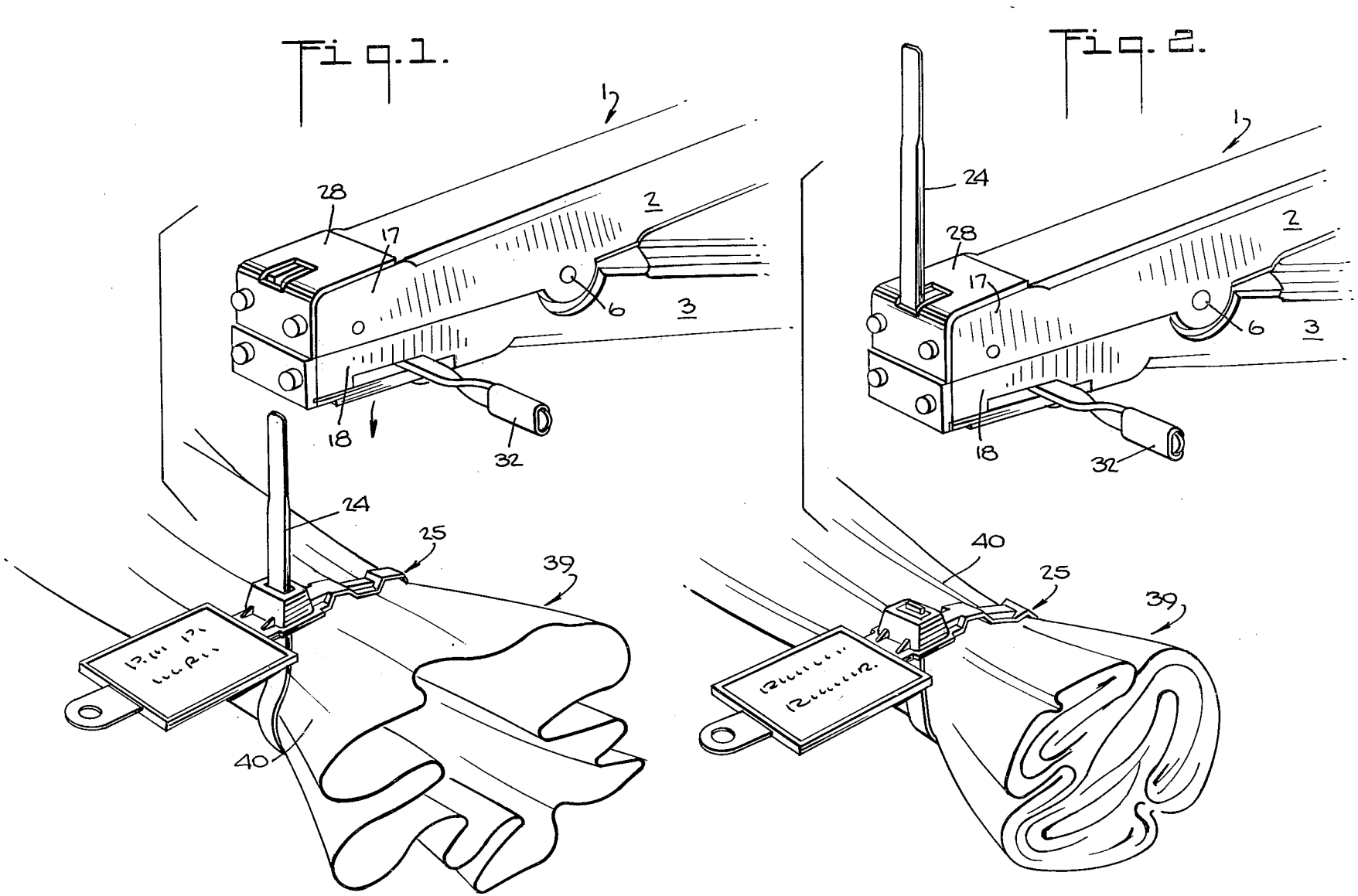
FIGS. 1 and 2 are perspective views illustrating the hand tool in successive money bag sealing steps.

The tool of the invention is used for tightening sealing ties or straps such as are used on money bags or cables or similar objects where a strap is tightly applied to encircle or close the bag or grip the cables. The tool is particularly useful for sealing money bags where the bag ties must be pulled extremely tightly around the bag neck thereby preventing their unauthorized removal. For this use, the tool must provide a consistently high and preset application force to assure that each tie has been applied with a predetermined force. After application it is also desirable that the tool cut the tie close to the bag for further preventing undetected tampering or removal of the bag seal.

The preferred embodiment of the tool, in accordance with the invention, is a plier-like tool 1 having a pair of pivotally connected handles 2 and 3. Each of the handles is formed by molding or otherwise of a suitable strong material such as metal or plastic. As best seen in FIG. 3, the handles 2 and 3 include complimentary bearing portions 4 and 5 for accomodating a pivot pin 6. Hollowed-out inner portions 7 and 8 within the handles 2 and 3, as illustrated in FIG. 3, contain a wire spring 9 having extending spring arms 10 and 11. The spring 9 normally holds the handles 2 and 3 apart and permits them to be moved to a closed position against the force of the spring 9 to operate the tool. The operating portion of the tool 1, which is a ratchet device 12, is mounted at the forward ends or jaws 17 and 18 of the two handles 2 and 3. As best illustrated in the enlarged FIGS. 6, 7 and 8, the ratchet device 12 includes a cam pawl 13 pivotally mounted on a shaft 14 within a slot 15 in the upper handle 2. The cam pawl 13 has a strap engaging tooth 16 on its forward end positioned for engaging the tie being tightened. The pawl action is obtained by urging the cam pawl 13 in a counter-clockwise direction (FIG. 3) by a compression spring 19 positioned between the cam pawl 13 and a spring receiving aperture 20 in the upper handle 2. The rear surface 21 of the cam pawl 13 is spaced from the rear slot edge 22 which limits the cam pawl 13 rotation in the counter-clockwise direction. When the tool 1 is in its inoperative position, the lower surface of the cam pawl 13 rests on a flat upper surface 23 of the jaw 18 of the lower handle 3.

A slot 26 is provided in the lower jaw 18 for passage of the free end 24 of the tie 25. An extension of this slot is formed in the upper jaw 17 in front of the cam pawl 13 by the slot 15 and a pressure plate 28. A slotted plate 29 attached to the bottom of the lower jaw 18 slidably contains a tie cutting knife 30 in a slot 31. The knife 30 is moved forwardly and through the tie 25 by an operating arm 32 pivotally attached to the knife 30 at 33 and to the jaw 18 at 34. A compressed coil spring 35 urges the knife 30 towards its inoperative position.

A cam wire 36 having relatively sharp free edges 37 is mounted in a suitable aperture 38 so that its edges 37 engage the tie as the tie is moved through the slot 26 to prevent upward movement of the jaw 18 on the tie 25 during the tool placement and operation.

OPERATION

The operation of the tool 1 in tightening a tie 25 on a bag 39 is illustrated in FIGS. 4 and 5. FIG. 4 illustrates a bag tie 25 loosely applied to a bag 39 neck 40 and pulled hand tight. The tool 1 is then slipped over the free end of the bag tie 25. The tool 1 is pressed downwardly until the bottom of the lower handle jaw 18 rests on the pawl portion 41 of the bag tie 25. As the tie 25 is passed through slot 26 and past the cam pawl 13 the jaws 17 and 18 are opened to permit the cam pawl 13 to rock freely, and the tooth 16 to slide over the inclined edges 42 of the tie teeth 43. The tool handles 2 and 3 are now pressed together so that the tooth 16 engages the sharp edges 44 of the tie teeth 43 and draws the tie 25 past the cam wire 36 progressively tightening the tie 25 on the bag 39. The tool 1 is operated by full or partial handle closings until the tie 25 is drawn so tightly that it cannot be further tightened with a normal hand pressure on the tool 1. Further closing of the tool 1 now completes the sealing by applying an increasing force to the tie 25 resulting from the resistance of the tie 25 to further advancement by the cam pawl 13. At a point when the tie 25 has been extremely tightly drawn around the bag neck 40 so that further tie movement by the tool 1 does not occur, a greater increased hand pressure is required for further operation of the tool handles. Since the tie 25 cannot be advanced further through the ratchet movement of the handles 2 and 3, handle movement is only permitted by a counter-clockwise movement of the cam pawl 13 in the manner illustrated in full lines in FIG. 5. As the cam pawl 13 is drawn to the position of FIG. 5 with cam edge 21 against slot edge 22 due to the force applied by the handles 2 and 3, the cam 13 necessarily cuts at least partially through the bag tie 25 since rotation of the cam pawl 13 to its full counter-clockwise position moves the cam tooth 16 towards the cam pressure plate 28 a predetermined distance. The tooth 16 and cam pawl 13 are proportioned so that in the extreme position the tooth 16 moves well into the bag tie 25 as for example, at least one-half way through it. When this has occured the force applied to the handles 2 and 3 by the tool user is sufficient to break the tie 25 at the indentation formed by the cam tooth 16. Since this partial notching or cutting of the tie 25 is required before the tie 25 is broken by the force applied, this automatically assures that the bag tie 25 has been very tightly wrapped around the sealed bag 39 with the bag neck 40 folds being tightly compressed as illustrated in FIG. 5, and with the usual locking points 45 or other bag engaging means on the tie pulled tightly against and into the material of the bag neck 40.

It is now desirable for reasons of security as well as convenience to cut the bag tie 25 off at a point just beyond the tie locking pawl 41. This is accomplished by swinging the tool cutting knife 30 forward from the position illustrated in FIG. 6 to the position illustrated in FIG. 8 where both the tool 1 and the cut tie end 24 are separated from the sealed bag 39.

FIG. 5 illustrates the cam pawl 13 in its final pressure position as the tool operator has applied the tie severing force to the tool handles 2 and 3. In this position the lower rear edge 21 of the cam pawl 13 has been moved against the surface 22 of the cam slot 15 in the upper tool handle 2. The cam tooth 16 size is proportioned in this position to cut a desired distance through the tie 25 as the tie 25 is forced by the tooth 16 against the cam pressure plate 28. For example, for plastic ties such as nylon ties supplied in a form having a cross-section of about ¼ inch by 1/16 inch, the cam pawl 13 may be proportioned to cut approximately half way through the tie 25 at this point for controlling the severing of the tie.

The force required to sever a tie for various materials is determined by using the known material strength of the remaining uncut tie cross-section and the force on the tie obtained from the leverage applied at tooth 16 by the handles 2 and 3.

It will be seen that an improved sealing or applicator tool has been provided for use with fasteners such as bag ties for operations such as sealing money bags or the like. A convenient and simple tool has been described which readily tightens the tie and which assures that the tie is applied with the necessary degree of force for forming a proper bag seal. This result is obtained by an automatically tie severing means in the tool. In addition, a tie cutting knife is provided for severing the tie close to its pawl locking portion. When a tie is closely severed in this manner, it is left in convenient and tamper-proof form and has been shortened so that it cannot be reapplied even though an attempt is made to tamper with the sealed bag by somehow removing and attempting to reapply a particular coded money bag seal.

As various changes may be made in the form, construction and arrangement of the parts herein without sacrificing any of its advantages, it is to be understood that all matter herein is to be interpreted as illustrative and not in a limiting sense.

Having thus described my invention, I claim:

1. A strap tightening tool for applying strap-like fasteners comprising the combination of:

a pair of handle members pivotally connected together intermediate their ends;

a pivot forming the said pivotal connection;

strap engaging and advancing means on said handles;

means for severing the strap at a predetermined strap engaging force; and an additional strap severing means positioned for cutting an additional portion from the applied strap.

2. The tool as claimed in claim 1 in which said severing means comprises a pivotally mounted cam pawl positioned for engaging the strap and including a relatively sharp strap engaging cam tooth.

3. The tool as claimed in claim 2 which further comprises spring means positioned in said tool for urging the cam tooth against the strap and abutment means on said cam pawl for limiting the movement of said cam tooth toward the strap.

4. The tool as claimed in claim 3 which further comprises a pressure plate positioned on said tool opposite to said cam pawl.

5. The tool as claimed in claim 1 in which said additional strap severing means comprises a slidably mounted knife and means for moving said knife towards and away from the strap.

* * * * *